US008548362B2

(12) United States Patent
Okuda

(10) Patent No.: US 8,548,362 B2
(45) Date of Patent: Oct. 1, 2013

(54) TONER STIRRING MEMBER AND TONER CARTRIDGE INCLUDING THEREOF

(75) Inventor: Takeshi Okuda, Osaka (JP)

(73) Assignee: Sharp Kabushiki Kaisha, Osaka-Shi (JP)

( * ) Notice: Subject to any disclaimer, the term of this patent is extended or adjusted under 35 U.S.C. 154(b) by 0 days.

(21) Appl. No.: 13/325,474

(22) Filed: Dec. 14, 2011

(65) Prior Publication Data

US 2012/0155926 A1 Jun. 21, 2012

(30) Foreign Application Priority Data

Dec. 17, 2010 (JP) ..... 2010-282193

(51) Int. Cl.
*G03G 15/08* (2006.01)

(52) U.S. Cl.
USPC ..... 399/263

(58) Field of Classification Search
USPC ..... 399/263, 265
See application file for complete search history.

(56) References Cited

U.S. PATENT DOCUMENTS

| | | | | |
|---|---|---|---|---|
| 2006/0051135 | A1* | 3/2006 | Sato et al. | 399/258 |
| 2006/0067735 | A1 | 3/2006 | Sanada et al. | |
| 2006/0222414 | A1 | 10/2006 | Yamamura | |

FOREIGN PATENT DOCUMENTS

| | | | |
|---|---|---|---|
| JP | 2005-70702 | A | 3/2005 |
| JP | 2006-106045 | | 4/2006 |
| JP | 2005-276615 | A | 10/2006 |
| JP | 2006-276615 | A | 10/2006 |
| JP | 2009-294299 | | 12/2009 |

* cited by examiner

*Primary Examiner* — Walter L Lindsay, Jr.
*Assistant Examiner* — Barnabas Fekete
(74) *Attorney, Agent, or Firm* — Nixon & Vanderhye P.C.

(57) ABSTRACT

A toner stirring member includes a stirring blade made of a flexible sheet having a first insertion hole, and a rotation shaft having a nipping section for nipping an edge the flexible sheet such that the flexible sheet can be inserted into and pulled out from the nipping section. An inclining projection on the rotation shaft is inserted into the first insertion hole. The flexible sheet is nipped by the nipping section, and the inclining projection is inserted into the first insertion hole, so that the stirring blade is fixed to the rotation shaft. The inclining projection has a first inclining surface that inclines in a direction in which the flexible sheet is pulled out from the nipping section.

9 Claims, 4 Drawing Sheets

200
301

206
207a
207b
208a
208b
B
B'

206
207a、207b
DIRECTION IN WHICH SHEET IS INSERTED
208a
C
C' 302
208b
218a
218b
218

206
207a
208b
D
218a
208a
303
E
207b
218a
DIRECTION IN WHICH SHEET IS PULLED 207a
302
DIRECTION IN WHICH SHEET IS PULLED 207b
303
302
DIRECTION IN WHICH SHEET IS PULLED

207b'
303
302
DIRECTION IN WHICH SHEET IS PULLED 208a
304a
304b 208a
306

TONER STIRRING MEMBER AND TONER CARTRIDGE INCLUDING THEREOF

This Nonprovisional application claims priority under 35 U.S.C. §119(a) on Patent Application No. 2010-282193 filed in Japan on Dec. 17, 2010, the entire contents of which are hereby incorporated by reference.

TECHNICAL FIELD

The present invention relates to an electrophotographic image forming apparatus, particularly relates to a toner cartridge to be provided in an image forming apparatus.

BACKGROUND ART

An image forming apparatus for forming an image by means of an electrophotographic printing method can form a high-definition image with an easy operation. It is also easy to keep the image forming apparatus in good condition. Accordingly, the image forming apparatus has been frequently used for, for example, a copying machine, a printer or a facsimile, and therefore has been in widespread use. A typical electrophotographic image forming apparatus includes (i) a photoreceptor drum for forming an electrostatic latent image, (ii) a developing device for developing an electrostatic latent image to form a toner image, (iii) a transfer device for transferring a toner image onto a sheet, and (iv) a fixing device for fixing a toner image onto a sheet.

In such an image forming apparatus, toner to be consumed is replenished after toner present in the image forming apparatus is completely consumed. Meanwhile, when the toner is replenished to the image forming apparatus, the toner is possibly scattered in the air, or hands of a supplier are possibly contaminated with the toner. This is because the toner is made up of very light fine particles. In order to prevent the toner particles from being scattered in the air, a toner cartridge that contains toner, which is configured to be detachable from the image forming apparatus and exchangeable as it is, has been frequently used. The toner cartridge is exchanged as follows. An empty cartridge is detached from an image forming apparatus, and a new cartridge is attached to the image forming apparatus. The empty cartridge is refilled with toner, and reused. Alternatively, since awareness about an environmental problem has been recently raised, material recycling in which the empty cartridge is not discarded but recycled as a resin material has been promoted.

However, the image forming apparatus from which the toner cartridge is detachable causes a problem that toner fluidity deteriorates and therefore it becomes difficult to supply toner from the toner cartridge to a developing device or to an intermediate toner hopper in a case where the toner cartridge is left in the image forming apparatus for a long period. In order to solve the problem, for example, Patent Literature 1 discloses a toner cartridge including a toner stirring member with a stirring blade in its toner container so that the toner fluidity is improved.

CITATION LIST

Patent Literature

Patent Literature 1

Japanese Patent Application Publication, Tokukai No. 2006-106045 A (Publication Date: Apr. 20, 2006)

SUMMARY OF INVENTION

Technical Problem

In a toner cartridge including a toner stirring member with a stirring blade, the stirring blade rotates in a toner container, and stirs toner like it sweeps the inside of the toner container. Therefore, the stirring blade is likely to be more deteriorated than other members that constitute the toner cartridge. The deteriorated stirring blade is occasionally exchanged in a case where the toner cartridge is renewed.

Further, it is necessary to detach the stirring blade from the toner container in a case where material recycling is carried out. This is because the stirring blade is often made up of a flexible material different from a resin material of which the toner container is made up, and therefore the material recycling cannot be carried out with respect to the stirring blade when the material recycling is carried out with respect to the toner container.

In order to detach the stirring blade of the toner cartridge disclosed in Patent Literature 1 from the toner container, it is necessary to partially disassemble a wall of the toner container. Such detachment of the stirring blade requires much labor.

The present invention was made in view of the problem, and an object of the present invention is to provide (i) a toner stirring member from which a stirring blade is easily detachable and (ii) a toner cartridge including the toner stirring member.

Solution to Problem

In order to attain the object, a toner stirring member of the present invention, including a stirring blade made up of a flexible sheet having an insertion hole; and a rotation shaft having (i) a nipping section for nipping the flexible sheet such that the flexible sheet can be inserted/pulled out into/from the nipping section and (ii) a projecting section to be inserted into the insertion hole, the toner stirring member being configured such that the stirring blade is fixed to the rotation shaft when the toner stirring member is in such a state that (a) the flexile sheet is nipped by the nipping section and (b) the projecting section is inserted into the insertion hole, the projecting section having a first inclining surface that inclines in a direction in which the flexible sheet is pulled out from the nipping section.

Advantageous Effects of Invention

According to the configuration, the projecting section of the rotation shaft, to be inserted into the insertion hole of the flexible sheet of which the stirring blade is made up, has the first inclining surface that inclines in the direction in which the flexible sheet is pulled out from the nipping section. Therefore, in a case where force is applied in the direction in which the flexible sheet is pulled out from the nipping section while the projecting section is being inserted into the insertion hole (insertion state), a rear edge part of the insertion hole which rear edge part is present in the direction in which the flexible sheet is pulled out from the nipping section slides along the first inclining surface. This allows easy detachment of the stirring blade from the rotation shaft with relatively small force.

Therefore, in a case where the stirring blade deteriorates, the stirring blade can be easily exchanged for a short period of time. Since the stirring blade can be detached from the rotation blade with relatively small force, it is possible to prevent a piece of the stirring blade that is partially damaged from being left in a toner container. Hence, material recycling can be carried out without a process that requires much labor.

The flexile sheet of the stirring blade is nipped by the nipping section of the rotation shaft, and the projecting section of the rotation shaft is inserted into the insertion hole of the flexible sheet, so that the stirring blade is fixed to the rotation shaft. This yields an effect that the stirring blade is unlikely to be detached from the rotation shaft while stirring toner.

Note that it can also be said that the first inclining surface inclines in the direction in which the flexible sheet is pulled out from the nipping section such that a cross section of an edge of the projecting section is diminished.

BRIEF DESCRIPTION OF DRAWINGS

FIG. 1(*b*) is a perspective view of a toner stirring member.

FIG. 1(*c*) is a cross-sectional view taken along the BB' line of the toner stirring member of FIG. 1(*b*).

FIG. 1(*d*) is a cross-sectional view taken along the CC' line of the toner stirring member of FIG. 1(*c*).

FIG. 1(*e*) is a view of a projection of the toner stirring member of FIG. 1(*d*), which projection is viewed from a direction D.

FIG. 1(*f*) is a view of another projection of the toner stirring member of FIG. 1(*d*), which projection is viewed from a direction E.

FIG. 1(*g*) is a view showing another example of a projection.

FIG. 1(*h*) is a view of a sheet.

FIG. 1(*i*) is a view showing another example of the sheet.

FIG. 4(*b*) is a cross-sectional view taken along AA' line of the toner cartridge of FIG. 4(*a*).

DESCRIPTION OF EMBODIMENTS

The following describes in detail an embodiment of the present invention with reference to drawings.

[Image Forming Apparatus]

Figure 2:
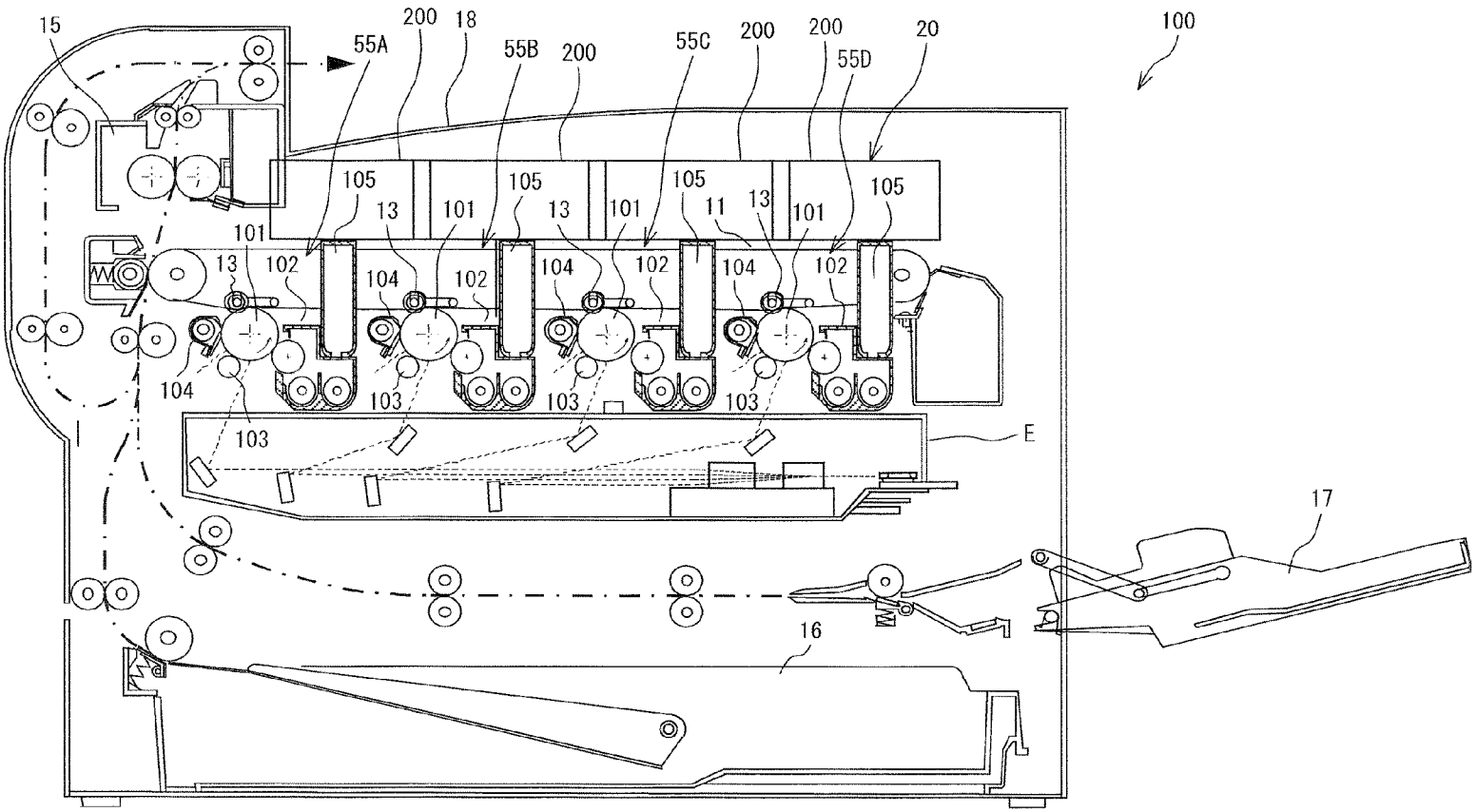
FIG. 2 is a longitudinal cross-sectional view schematically showing an example of a configuration of an image forming apparatus in accordance with an embodiment of the present invention.

Firstly, the following description discusses a while configuration of an image forming apparatus provided with a toner cartridge including a toner stirring member of the present invention. FIG. 2 is a longitudinal cross-sectional view schematically showing an example of a configuration of an image forming apparatus 100 in accordance with the present embodiment. Note that the image forming apparatus of the present invention is not limited to the following image forming apparatus, provided that the toner cartridge including the toner stirring member (later described) of the present invention can be provided in the image forming apparatus of the present invention.

As shown in FIG. 2, the image forming apparatus 100 includes an exposure unit E, four image forming sections (image forming stations) 55A through 55D, an intermediate transfer belt 11, a second transfer roller 14, a fixing device 15, a paper feeding cassette 16, a manual paper feeding tray 17, a paper output tray 18, a toner cartridge unit 20, and like members. For example, a scanner can be further provided above the image forming apparatus 100. Operations of members included in the image forming apparatus 100 are controlled by a main control section constituted by, for example, a CPU (not shown).

The four image forming sections 55A through 55D basically have an identical configuration with one another. Each of the four image forming sections 55A through 55D has (i) a photoreceptor (image bearing member) 101 and (ii) a charging device 103, a developing device 102, a first transfer roller 13 and a cleaning unit 104, and like members that are provided around the photoreceptor 101.

The exposure unit E exposes, to light in accordance with image data, a surface of the photoreceptor 101 which surface is charged by the charging device 103, so that an electrostatic latent image is formed on the surface of the photoreceptor 101. A toner image in accordance with the electrostatic latent image is formed by use of toner supplied by the developing device 102. The toner image formed on the surface of the photoreceptor 101 is transferred onto the intermediate transfer belt 11 provided above the photoreceptor 101. The first transfer roller 13 is provided so as to face the photoreceptor 101 via the intermediate transfer belt 11. Four toner images having different colors (black, cyan, magenta and yellow, in the present embodiment), which are formed by the four image forming sections 55A through 55D, respectively, are superimposed to one another on an outer surface of the intermediate transfer belt 11.

The toner images transferred onto the outer surface of the intermediate transfer belt 11 are carried so as to face the second transfer roller 14 by rotation of the intermediate transfer belt 11, and then transferred onto a paper (sheet material) fed from the paper feeding cassette 16 or the manual paper feeding tray 17. The toner images transferred onto the paper are fixed to the paper by passing through the fixing device 15 provided forward in a direction in which the paper is carried. Thereafter, the paper is discharged onto the paper output tray 18.

The toner cartridge unit 20 is provided above the developing device 102, so as to supply toner to the developing device 102. In the toner cartridge unit 20 of the present embodiment is provided four toner cartridges 200 that contain black, cyan, magenta and yellow toners to be used, respectively, and that are detachable from the toner cartridge unit 20. Toner is supplied from the toner cartridges 200 to corresponding developing devices 102 via corresponding toner supply pipes 105. The following describes the toner cartridges 200.

[Toner Cartridge]

The following description discusses in detail configuration of the toner cartridge including the toner stirring member of the present invention, with reference to drawings.

Figure 3:
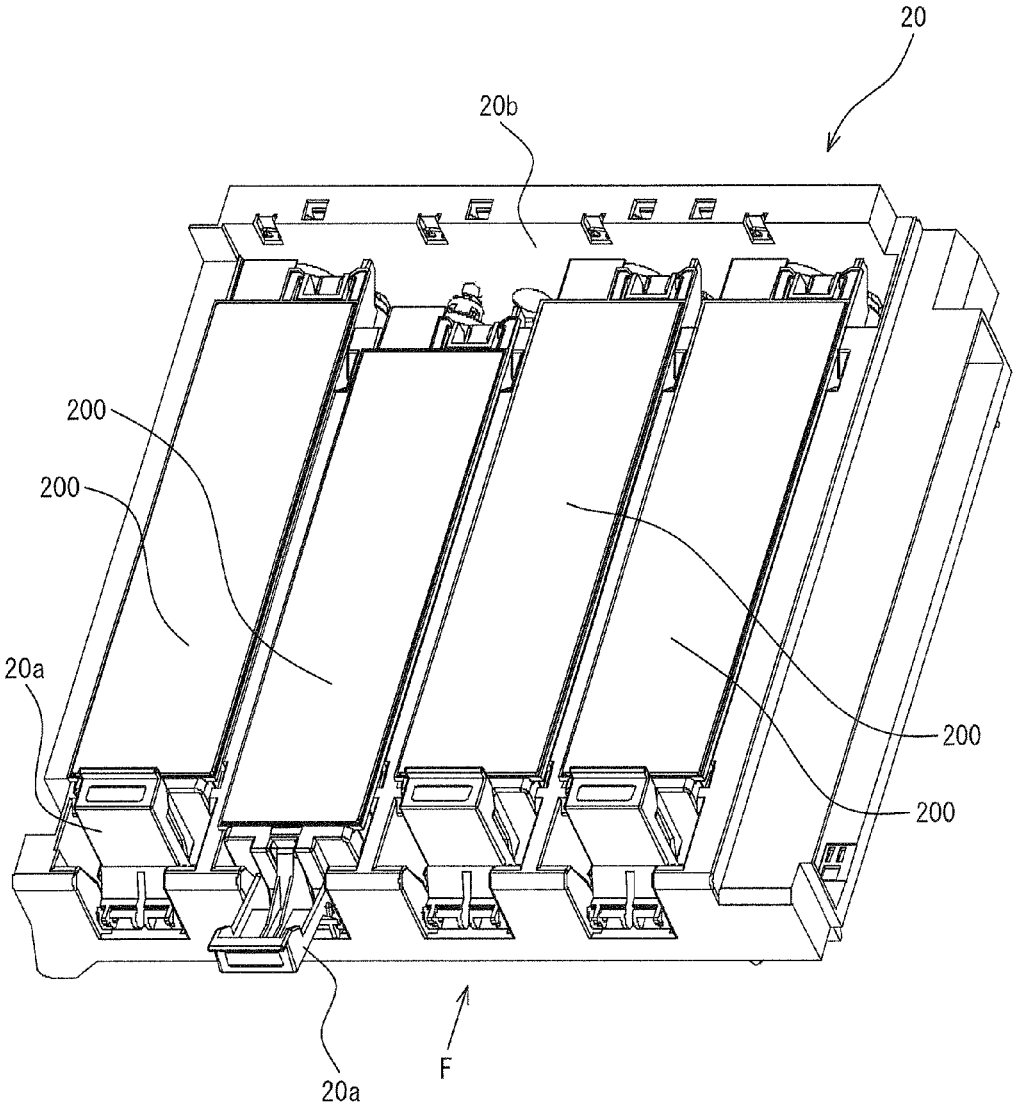
FIG. 3 is a perspective view showing a configuration of a toner cartridge unit in which toner cartridges to be provided in the image forming apparatus of FIG. 2 are provided.

FIG. 3 is a perspective view showing a configuration of the toner cartridge unit 20 in which the toner cartridges 200 to be provided in the image forming apparatus 100 in accordance with the present embodiment are provided. In the toner cartridge unit 20 of the present embodiment is provided four toner cartridges 200 that contain black, cyan, magenta and yellow toners, respectively. Alternatively, for example, two toner cartridges 200 each of which contains black toner can be provided in the toner cartridge unit 20. That is, five toner cartridges 200 in total can be provided in the toner cartridge unit 20. As such, the number of toner cartridges 200 to be provided in the toner cartridge unit 20 is not limited. The toner cartridges 200 to be provided in the toner cartridge unit 20 basically have an identical configuration and function with one another even in a case where the toner cartridges 200 contain different colored toners from one another.

Figure 4:
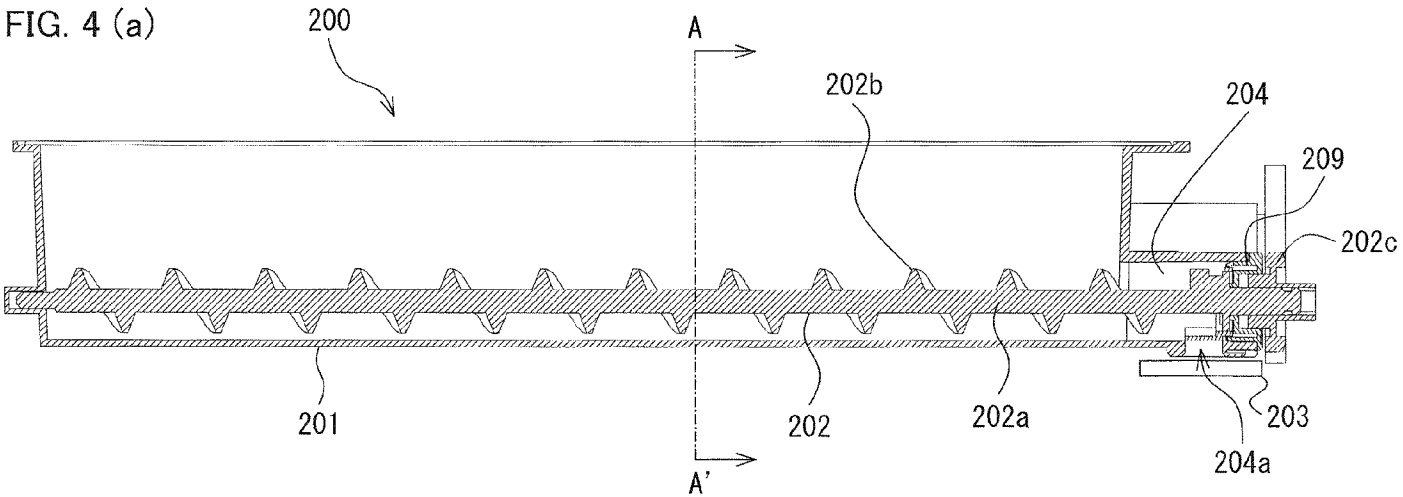
FIG. 4(*a*) is a lateral cross-sectional view of a toner cartridge.
Figure 4:
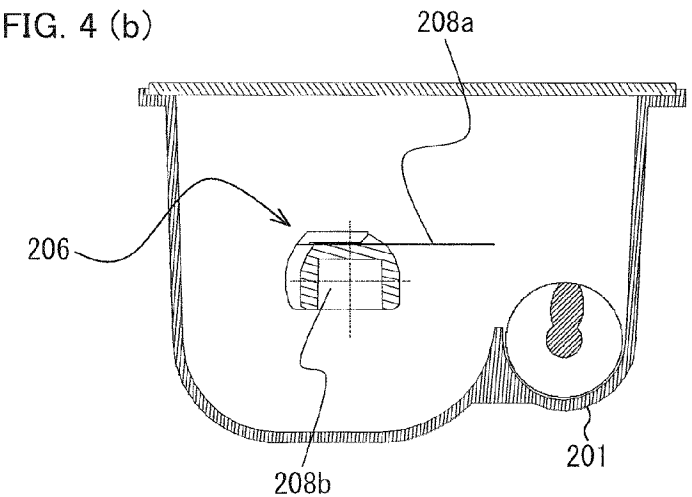

FIG. 4(*a*) is a cross-sectional view of a side of the toner cartridge 200 to be provided in the image forming apparatus 100. FIG. 4(*b*) is a cross-sectional view taken along AA' line of the toner cartridge 200 of FIG. 4(*a*).

As shown in FIG. 3, the toner cartridges 200 are aligned in the toner cartridge unit 20 such that the toner cartridges 200 are detachable from the toner cartridge unit 20. As shown in FIG. 3, a toner container (toner containing section) 201 of each of the toner cartridges 200 is moved in a direction indicated by an arrow F of FIG. 3 by lifting a lock lever 20*a*, and kept being pressed to a stopper plate 20*b*. The toner container 201 of the toner cartridge 200 moves in a direction substantially horizontal to a toner supply pipe 105, as shown in FIG. 2. This allows a shutter 203 to move in the direction. The shutter 203 is opened when a toner discharge opening 204*a* is positioned so as to face the toner supply pipe 105. In this manner, toner is supplied from an upper surface of the toner supply pipe 105 to the developing device 102.

As shown in FIGS. 4(*a*) and 4(*b*), the toner cartridge 200 includes the toner container 201 for containing toner, an auger screw 202, the toner discharge opening 204*a*, the shutter 203, the toner stirring member 206, and an auger screw support bearing 209.

The tone container 201 includes a substantially cylindrical toner discharging section 204 having a cross section whose shape is square at its front and round at its rear. The toner container 201 is a substantially prismatic container for containing toner. The auger screw 202 and the toner stirring member 206 are rotatably supported in the tone container 201. The toner container 201 is made up of ABS or PS (for example, having a thickness of approximately 1.5 mm).

The auger screw 202 includes a rotation shaft 202*a*, a spiral blade 202*b* and a driving gear 202*c*. The auger screw 202 rotates to carry tone present in the toner container 201 toward the toner discharge opening 204*a*.

The toner stirring member 206 includes a single stirring blade 208*a* attached to and is extended axially outwardly from a rotation shaft 208*b*, and is configured to stir toner in the toner container 201 by rotating about the rotation shaft 208*b* in the toner container 201. The toner stirring member 206 is later described in detail.

The shutter 203 is a substantially square plate-like shut-off valve member that is slidably provided so as to close the toner discharge opening 204*a*. The shutter 203 is opened when the toner cartridge 200 is provided in the image forming apparatus 100.

[Toner Stirring Member]

The following describes the toner stirring member 206 of the present embodiment.

Figure 1:
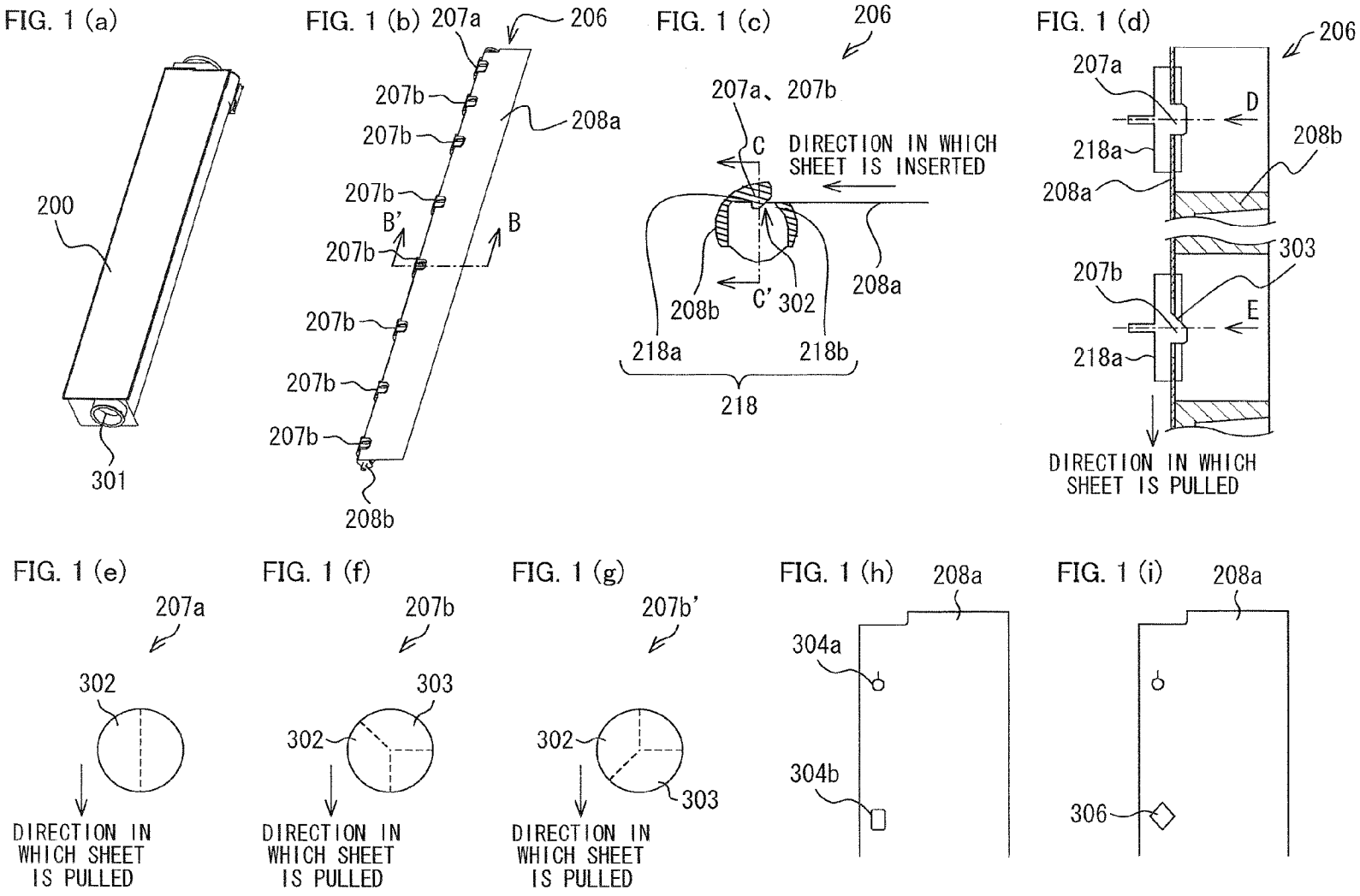
FIG. 1(*a*) is a perspective view of a toner cartridge.

As shown in FIG. 1(*a*), the toner cartridge 200 has a side surface where a first opening 301 via which the inside of the toner cartridge 200 communicates with the outside of the toner cartridge 200 is formed. Toner is supplied into the toner container 201 through the first opening 301. A cap member is normally attached to the first opening 301, and seals the first opening 301, so that toner does not leak out from the first opening 301.

FIG. 1(*b*) shows the toner stirring member 206. As described above, the toner stirring member 206 includes the stirring blade 208*a* and the rotation shaft 208*b*. FIG. 1(*c*) is a cross-sectional view taken along BB' line of the toner stirring member 206 of FIG. 1(*b*). FIG. 1(*d*) is a cross-sectional view taken along the CC' line of FIG. 1(*c*).

The stirring blade 208*a* is a substantially rectangle member made up of a flexible sheet having a plurality of insertion holes 304*a* and 304*b*. The flexible sheet is preferably made up of, for example, polyethylene terephthalate having a thickness not less than 0.1 mm but not more than 0.3 mm.

In a case where the flexible sheet of which the stirring blade 208*a* is made up is made up of polyethylene terephthalate having such a thickness, the stirring blade 208*a* is excellent in balance between rigidity and flexibility, and can properly stir toner. Further, the use of such a stirring blade 208*a* facilitates exchanging or recycling of the stirring blade 208*a* by making the stirring blade 208*a* detachable from the rotation shaft by being bent with relatively small force. This improves workability in the exchanging or recycling of the stirring blade 208*a*. Note that the flexible sheet can be made up of a material other than polyethylene terephthalate. How to detach the stirring blade 208*a* from the rotation shaft 208*b* is later described.

As shown in FIG. 1(*h*), the plurality of insertion holes 304*a* and 304*b* formed on the flexible sheet of the stirring blade 208*a* include one circular first insertion hole (cross-section shaped insertion hole) 304*a* formed on an edge part of the flexible sheet, and a plurality of elliptic second insertion holes (insertion holes) 304*b*.

The rotation shaft 208*b* is made up of, for example, ABS or PS, as with the toner container 201. As shown in FIGS. 1(*b*) and 1(*d*), the rotation shaft 208*b* has a plurality of projections 207*a* and 207*b*. The plurality of projections 207*a* and 207*b* include one columnar projection (columnarly projecting section) 207*a* provided in an edge part of the rotation shaft 208*b* and a plurality of inclining projections (projecting sections) 207*b*. These projections 207*a* and 207*b* are inserted into the plurality of insertion holes 304*a* and 304*b* of the stirring blade 208*a*, respectively.

As shown in FIG. 1(*c*), the rotation shaft 208*b* also has nipping sections 218 for nipping the flexible sheet of the stirring blade 208*a* such that the flexible sheet of the stirring blade 208*a* can be inserted into and pulled out from the nipping sections 218. Each of the nipping sections 218 includes a first nipping section 218*a* for supporting one surface of the stirring blade 208*a*, and a second nipping section 218*b* for supporting the other surface of the stirring blade 208*a*. According to the present embodiment, as shown in FIG. 1(*c*), a base for supporting each bottom part of the projections 207*a* and 207*b* also serves as the first nipping section 218*a*.

In the toner stirring member 206, the flexible sheet of the stirring blade 208*a* is nipped by the nipping sections 218, and the plurality of projections 207*a* and 207*b* are inserted into the plurality of insertion holes 304*a* and 304*b*, so that the stirring blade 208 is fixed to the rotation shaft 208*b*.

The inclining projections 207*b* are cylindrical projections. As shown in FIG. 1(*d*), each of the inclining projections 207*b* includes a first inclining surface 303 that inclines in a direction in which the flexible sheet of the stirring blade 208*a* is pulled out from the nipping sections 218 (in a sheet pulling-out direction). FIG. 1(*f*) is a view of the inclining projection 207*b* which is viewed from a direction indicated by an arrow E of FIG. 1(*d*) (a view of the inclining projection 207*b* which is viewed from an edge of the inclining projection 207*b*).

It can also be said that the first inclining surface 303 inclines in the sheet pulling-out direction such that a cross section of an edge of the inclining projection 207*b* is diminished.

In a case where a line segment of an edge surface of the inclining projection 207*b* which line segment is perpendicular to the sheet pulling-out direction is an edge surface line segment, it can be said that the first inclining surface 303 is a surface including (i) the edge surface line segment and (ii) a line segment of a cross section of a projecting direction of the inclining projection 207*b* other than the edge surface of the inclining projection 207*b*, which line segment is parallel to the edge surface line segment and is present more upstream in the sheet pulling-out direction than the edge surface line segment.

In the present embodiment, the flexible sheet of the stirring blade 208*a* is pulled out from the nipping sections 218 in a shaft direction (in a longitudinal direction) of the rotation shaft 208*b* and in a direction toward the first opening 301. It can be accordingly said that the first inclining surface 303 inclines toward the first opening 301 in the shaft direction of the rotation shaft 208*b*.

Alternatively, for example, the flexible sheet of the stirring blade 208*a* can be pulled out from the nipping sections 218 in the shaft direction (in the longitudinal direction) of the rotation shaft 208*b* and in a direction toward the toner discharging section 204. In this case, the first inclining surface 303 inclines toward the toner discharging section 204 in the shaft direction of the rotation shaft 208*b*.

The first inclining surfaces 303 of the inclining projections 207 allow rear edge parts of the second insertion holes 304*b* which rear edge parts are present in the sheet pulling-out direction to slide along the first inclining surfaces 303 in a case where, while the inclining projections 207*b* are being inserted into the second insertion holes 304*b*, force is applied in the direction in which the flexible sheet is pulled out from the nipping sections 218. It is accordingly possible to easily detach the stirring blade 208*a* from the rotation shaft 208*b* with relatively small force.

Therefore, the stirring blade 208*a* can be easily exchanged for a short period of time in a case where the stirring blade 208*a* is deteriorated. As described above, the stirring blade 208*a* can be easily detached from the rotation shaft 208*b* with relatively small force. It is therefore possible to prevent a piece of the stirring blade 208*a* that is partially damaged from being left in the toner container 201. Hence, material recycling can be carried out without a process that requires much labor.

The flexible sheet of the stirring blade 208*a* is nipped by the nipping sections 218 of the rotation shaft 208*b*, and the plurality of projections 207*a* and 207*b* are inserted into the plurality of insertion holes 304*a* and 304*b* of the flexible sheet, so that the stirring blade 208*a* is fixed to the rotation shaft 208*b*. This yields an effect that the stirring blade 208*a* is unlikely to be detached from the rotation shaft 208*b* while stirring toner.

While stirring toner, the flexible sheet of the stirring blade 208*a* rotates about one edge of a lateral direction of the flexible sheet of the stirring blade 208*a* which edge is fixed to the rotation shaft 208*b*. This makes it difficult to apply force to the flexible sheet of the stirring blade 208*a* in the shaft direction of the rotation shaft 208*b*. Further, in the present embodiment, the shaft direction of the rotation shaft is parallel to the direction in which the flexible sheet is pulled out from the nipping sections 218. This makes it difficult to apply force to the flexible sheet of the stirring blade 208*a* in the direction in which the flexible sheet is pulled out from the nipping sections 218 while the stirring blade 208*a* is stirring toner. Hence, the stirring blade 208*a* can suitably stir toner without being easily detached from the rotation shaft 208*b*.

Generally, in a case where the flexible sheet of the stirring blade 208*a* has formed the plurality of second insertion holes 304*b* into which the plurality of inclining projections 207*b* are inserted, it takes a lot of time to detach the flexible sheet of the stirring blade 208*a* from the rotation shaft 208. However, according to the present embodiment, the first inclining surfaces 303 of the plurality of inclining projections 207*b* face in an identical direction along the shaft direction of the rotation shaft 208*b*. This makes it possible to detach the inclining projections 207*b* from the second insertion holes 204*b* at one time by pulling the flexible sheet of the stirring blade 208*a* in the shaft direction of the rotation shaft 208*b*, thereby quickly detaching the stirring blade 208*a* from the rotation shaft 208*b*.

As shown in FIGS. 1(*c*) and 1(*f*), each of the inclining projections 207*b* further includes a second inclining surface 302 that inclines in a direction in which the flexible sheet of the stirring blade 208*a* is inserted into the nipping sections 218. This makes it easy to insert the inclining projections 207*b* into the second insertion holes 304*b* by sliding the stirring blade 208 along the second inclining surfaces 302 of the inclining projections 207*b*, so that the stirring blade 208*a* is attached to the rotation shaft 208*b*. That is, a front edge part of the flexible sheet which front edge part is present in the direction in which the flexible sheet is inserted into the nipping sections 218 are inserted along the second inclining surfaces 302 of the inclining projections 207*b*. This allows the inclining projections 207*b* to be easily inserted into the second insertion holes 304*b*. It is accordingly possible to easily fix the stirring blade 208*a* to the rotation shaft 208*b*. Note that the other surface of each of the inclining projections 207*b* (each edge of the inclining projections 207*b*) other than the first inclining surface 303 and the second inclining surface 302 is flat.

The columnar projection 207*a* is cylindrical, and is inserted into the circular first insertion hole 304*a*. The columnar projection 207*a* functions as a projection for positioning the stirring blade 208*a* by being inserted in the circular first insertion hole 304*a*.

The first insertion hole 304*a* in which the columnar projection 207*a* is to be inserted has a shape identical to that of a cross section of the projecting direction of the columnar projection 207*a*, as shown in FIG. 1(*h*). Insertion of the columnar projection 207*a* into the first insertion hole 304*a* having the shape identical to that of the cross section of the projecting direction of the columnar projection 207*a* makes it possible to prevent the stirring blade 208*a* from moving in the rotation direction of the rotation shaft 208*b* in a case where force is accidentally applied to the stirring blade 208*a* while the stirring blade 208*a* is stirring toner. Further, it is possible to easily detach the stirring blade 208*a* from the rotation shaft 208*b* by detaching the columnar projection 207*a* from the first insertion hole 304*a*.

As shown in FIG. 1(*b*), the columnar projection 207*a* and the plurality of inclining projections 207*b* are provided along the shaft direction of the rotation shaft 208*b* such that the columnar projection 207*a* is provided in an edge part of the rotation shaft 208*b*. It is therefore possible to quickly detach the stirring blade 208*a* from the rotation shaft 208*b* by detaching the columnar projection 207*a* provided in the edge part of the rotation shaft 208*b* from the first insertion hole 304*a* and then just by pulling the stirring blade 208*a* in the direction of the rotation shaft 208*b* and in the direction toward the first opening 301 (in the direction in which the flexible sheet of the stirring blade 208*a* is pulled out from the nipping sections 218). According to the present embodiment, the columnar projection 207*a* is provided in the edge part of the rotation shaft 208*b* which edge part is closer to the toner discharging section 204. Alternatively, the columnar projection 207*a* can be provided in the other edge part of the rotation shaft 208*b* which other edge part is closer to the first opening 301.

An interval between the columnar projection 207*a* and the inclining projection 207*b* that is the closest to the columnar projection 207*a*, and intervals among the plurality of inclining projections 207*b* are not limited. Each of these intervals can be, for example, 30 through 60 mm. The number of the plurality of inclining projections 207*b* is neither limited. In FIG. 1(*b*), seven inclining projections 207*b* are provided. However, this is just an example.

As shown in FIG. 1(*h*), the flexible sheet of the stirring blade 208*a* has a slit or a cut formed at an edge part of the first insertion hole 304*a* which edge part is present upstream in the direction in which the flexible sheet is pulled out from the nipping sections 218 (in a direction of a normal line). Forming of the slit or the cut allows the first insertion hole 304*a* to expand in a case the stirring blade 208*a* is pulled out from the nipping sections 218. It is accordingly possible to quickly detach the columnar projection 207*a* from the first insertion hole 304*a* with small force.

As described above, the columnar projection 207*a* has the second inclining surface (inclining surface) 302 that inclines toward the direction in which the flexible sheet of the stirring blade 208*a* is inserted into the nipping sections 218, as shown in FIG. 1(*c*). FIG. 1(*e*) is a view showing the columnar projection 207*a* viewed from the direction indicated by the arrow D of FIG. 1(*d*) (viewed from an edge of the columnar projection 207*a*). It is therefore possible to easily insert the columnar projection 207*a* into the first insertion hole 304*a* by sliding the stirring blade 208*a* along the second inclining surface 302 of the columnar projection 207*a*, in a case where the stirring blade 208*a* is attached to the rotation shaft 208*b*. That is, it is possible to easily insert the columnar projection 207*a* into the first insertion hole 304*a* by inserting, along the second inclining surface 302 of the columnar projection 207*a*, the front edge part of the flexible sheet which front edge part is present in the direction in which the flexible sheet is inserted into the nipping sections 218. In this manner, the stirring blade 208*a* can be easily fixed to the rotation shaft 208*b*.

As shown in FIG. 1(*c*), the stirring blade 208*a* is inserted in "DIRECTION IN WHICH SHEET IS INSERTED" of FIG. 1(*c*) to be attached to the rotation shaft 208*b*. Since the inclining projections 207*b* and the columnar projection 207*a* have the second inclining surface 302, an edge of the stirring blade 208*a* (an edge of the stirring blade 208*a* which edge is present downstream in the "DIRECTION IN WHICH SHEET IS INSERTED") slides without being caught by the inclining projections 207*b* and the columnar projection 207*a* of the rotation shaft 208*b*. Thereafter, the inclining projections 207*b* and the columnar projection 207*a* are inserted into the second insertion holes and the first insertion hole, respectively, and the flexible sheet of the stirring blade 208*a* is nipped by the nipping sections 218 to be fixed.

As shown in FIGS. 1(*b*) and 1(*d*), the stirring blade 208*a* is detached from the rotation shaft 208*b* in the direction in which the flexible sheet of the stirring blade 208*a* is pulled out from the nipping sections 218, shown in "DIRECTION IN WHICH SHEET IS PULLED" of FIG. 1(*d*), that is, in the shaft direction of the rotation shaft 208*b* and in the direction toward the first opening 301. As shown in FIG. 1(*d*), the columnar projection 207*a* has no inclining surface that inclines from a side of the toner discharging section 204 opposite to the first opening 301 toward the "DIRECTION IN WHICH SHEET IS PULLED" of FIG. 1(*d*), so that the stirring blade 208*a* is not partially or completely detached from the rotation blade 208*b* while stirring toner. Meanwhile, since the first insertion hole 304*a* has the slit formed, it is possible to easily detach the columnar projection 207*a* from the first insertion hole 304*a* by pulling the stirring blade 208*a* in the "DIRECTION IN WHICH SHEET IS PULLED".

As shown in FIG. 1(*d*), the inclining projection 207*b* has the first inclining surface 303 that inclines from the side of the toner discharging section 204 opposite to the first opening 301 toward the "DIRECTION IN WHICH SHEET IS PULLED" of FIG. 1(*d*). It is accordingly possible to easily detach the inclining projections 207*b* from the second insertion holes 304*b* by sliding the stirring blade 208*a* such that the second insertion holes 304*b* are not caught by the inclining projections 207*b*.

As such, forming of the first inclining surfaces 303 on the inclining projections 207*b* makes it possible to detach the stirring blade 208*a* from the rotation shaft 208*b* with reduced pulling force such that the second insertion holes 304*b* of the stirring blade 208*a* are not caught by the inclining projections 207*b*.

On this account, the stirring blade 208*a* can be easily detached from the rotation shaft 208*b* with relatively small force. Note that, in a case where the columnar projection 207*a* does not have any slits, it is possible to easily detach the stirring blade 208*a* from the rotation shaft 208*b* with relatively small force by detaching the columnar projection 207*a* from the first insertion hole 304*a* and then pulling the stirring blade 208*a* in the "DIRECTION IN WHICH SHEET IS PULLED".

According to the present embodiment, the shaft direction of the rotation shaft 208*b* and the direction toward the first opening 301 correspond to the direction in which the flexible sheet of the stirring blade 208*a* is pulled out from the nipping sections 218. It is therefore possible to pull out only the stirring blade 208*a* through the first opening 301 provided that the toner stirring member 206 is provided so as to be viewed from the first opening 301.

Only one of the inclining projections 207*b* which one is the closest to the first opening 301 can be an inclining projection 207*b*', as shown in FIG. 1(*g*). The inclining projection 207*b*' has a first inclining surface 303 that inclines in a direction from the first opening 301 toward the toner discharging section 204. In this case, the stirring blade 208*a* is detached from the rotation shaft 208*b* as follows. Firstly, the inclining projection 207*b*' is detached from the second insertion hole 304*b* by slide of the stirring blade 208*a* in a direction opposite to the "DIRECTION IN WHICH SHEET IS PULLED" (in the direction from the first opening 301 toward the toner discharging section 204). Thereafter, the stirring blade 208*a* is pulled in the "DIRECTION IN WHICH SHEET IS PULLED", so that the other inclining projections 207*b* and the columnar projection 207*a* are detached from the second insertion holes 304*b* and the first insertion hole 304*a*, respectively.

Such easy detachment of the inclining projection 207*b*' from the second insertion hole 304*b* by use of the first inclining surface 303 formed merely on the inclining projection 207*b*' makes it possible to obtain a part of the flexible sheet of the stirring blade 208*a* which part is to be held by a user. The stirring blade 208*a* can be detached from the rotation shaft 208*b* with small force by pulling of the stirring blade 208*a* in the "DIRECTION IN WHICH SHEET IS PULLED" while holding the part.

According to the present embodiment, as described above, the columnar projection 207*a* and the inclining projections 207*b* are cylindrical. However, this is just an example. Alternatively, these projections can be, for example, prismatic. Further, according to the present embodiment, each of the columnar projection 207*a* and the inclining projections 207*b* has a flat edge. Alternatively, each of these projections can have, for example, a circular edge.

Further, according to the present embodiment, the first insertion hole 304*a* and the second insertion holes 304*b* are circular or elliptic. Alternatively, these insertion holes can be, for example, rectangular or rhombic (see FIG. 1(*i*)).

Further, according to the present embodiment, the flexible sheet of the stirring blade 208*a* has formed the cut at the edge part of the first insertion hole 304*a* which edge part is present upstream in the direction in which the flexible sheet is pulled out from the nipping sections 218 (in the direction of the normal line of the first insertion hole 304*a*). Alternatively, for example, a rectangular or V-shaped slit can be formed in the direction of the normal line, instead of the cut.

[Configuration of the Present Invention]

A toner stirring member of the present invention, including a stirring blade made up of a flexible sheet having an insertion hole; and a rotation shaft having (i) a nipping section for nipping the flexible sheet such that the flexible sheet can be inserted/pulled out into/from the nipping section and (ii) a projecting section to be inserted into the insertion hole, the toner stirring member being configured such that the stirring blade is fixed to the rotation shaft when the toner stirring member is in such a state that (a) the flexile sheet is nipped by the nipping section and (b) the projecting section is inserted into the insertion hole, the projecting section having a first inclining surface that inclines in a direction in which the flexible sheet is pulled out from the nipping section.

According to the configuration, the projecting section of the rotation shaft, to be inserted into the insertion hole of the flexible sheet of which the stirring blade is made up, has the first inclining surface that inclines in the direction in which the flexible sheet is pulled out from the nipping section. Therefore, in a case where force is applied in the direction in which the flexible sheet is pulled out from the nipping section while the projecting section is being inserted into the insertion hole (insertion state), a rear edge part of the insertion hole which rear edge part is present in the direction in which the flexible sheet is pulled out from the nipping section slides along the first inclining surface. This allows easy detachment of the stirring blade from the rotation shaft with relatively small force.

It is preferable to configure the toner stirring member of the present invention such that the direction in which the flexible sheet is pulled out from the nipping section be parallel to a shaft direction of the rotation shaft.

According to the configuration, the direction in which the flexible sheet is pulled out from the nipping section is parallel to the shaft direction of the rotation shaft. Force is unlikely to be applied to the flexible sheet of the stirring blade in the shaft direction of the rotation shaft while the stirring blade is stirring toner. Accordingly, while the stirring blade is stirring toner, force is unlikely to be applied to the flexible sheet of the stirring blade in the direction in which the flexible sheet is pulled out from the nipping section, and therefore the stirring blade is not easily detached from the rotation shaft. This allows suitable stirring of toner.

In general, in a case where a plurality of projecting sections and insertion holes are provided, it takes a lot of time to detach the flexible sheet from the rotation shaft. However, according to the configuration, first inclining surfaces of the plurality of projecting sections face in an identical direction along the shaft direction of the rotation shaft. This makes it possible to detach the projecting sections from the insertion holes at one time by pulling the flexible sheet of the stirring blade in the shaft direction of the rotation shaft. That is, the stirring blade can be quickly detached from the rotation shaft.

The toner stirring member of the present invention can be further configured such that the projecting section has a second inclining surface that inclines in a direction in which the flexible sheet is inserted into the nipping section.

According to the configuration, the projecting section has the second inclining surface that inclines in the direction in which the flexible sheet is inserted into the nipping section. This makes it easy to insert the projecting section into the insertion hole of the flexible sheet. That is, it is possible to easily insert the projecting section into the insertion hole by inserting, along the second inclining surface of the projecting section, a front edge part of the flexible sheet which front edge part is present in the direction in which the flexible sheet is inserted into the nipping section. This allows easy fixing of the stirring blade to the rotation shaft.

The toner stirring member of the present invention can be further configured such that the direction in which the flexible sheet is inserted into the nipping section is perpendicular to the shaft direction of the rotation shaft.

According to the configuration, the stirring blade can be easily attached to the rotation shaft.

The toner stirring member of the present invention can be further configured such that the rotation shaft has a columnarly projecting section that is cylindrical or prismatic in shape, and the flexible sheet has a cross-section shaped insertion hole having a shape identical to that of a cross section of a projecting direction of the columnarly projecting section, into which cross-section shaped insertion hole the columnarly projecting section is to be inserted.

According to the configuration, the columnarly projecting section is inserted into the cross-section shaped insertion hole having the shape identical to that of the cross section of the projecting direction of the columnarly projecting section. This makes it possible to prevent the stirring blade from moving in the shaft direction of the rotation shaft in a case where force is accidentally applied to the flexible sheet while the stirring blade is stirring toner. Further, it is possible to easily detach the stirring blade from the rotation shaft just by detaching the columnarly projecting section from the cross-section shaped insertion hole.

The toner stirring member of the present invention can be further configured such that the projecting section and the insertion hole include a plurality of projecting sections and a plurality of insertion holes, respectively, and the projecting sections and the columnarly projecting section are aligned in the shaft direction of the rotation shaft such that the columnarly projecting section is provided outmost among the projecting sections and the columnarly projecting section.

According to the configuration, the columnarly projecting section and the plurality of projecting sections are aligned in the shaft direction of the rotation shaft such that the columnarly projecting section is provided outmost among the projecting sections and the columnarly projecting section. It is therefore possible to quickly detach the stirring blade from the rotation shaft by detaching the columnarly projecting section provided outmost from the cross-section shaped insertion hole and then merely by pulling the flexible sheet of the stirring blade in the direction in which the flexible sheet of the stirring blade is pulled out from the nipping section.

The toner stirring member of the present invention can be further configured such that the flexible sheet has formed a slit or a cut at an edge part of the cross-section shaped insertion hole which edge part is present upstream in the direction in which the flexible sheet is pulled out from the nipping section.

According to the configuration, the flexible sheet has formed the slit or the cut at the edge part of the cross-section shaped insertion hole which edge part is present upstream in the direction in which the flexible sheet is pulled out from the nipping section. Therefore, the cross-section shaped insertion hole expands in a case where the flexible sheet is pulled out from the nipping section. It is accordingly possible to quickly detach the columnarly projecting section from the cross-section shaped insertion hole with small force.

The toner stirring member of the present invention can be further configured such that the columnarly projecting section has an inclining surface that inclines in the direction in which the flexible sheet is inserted into the nipping section.

According to the configuration, the columnarly projecting section has the inclining surface that inclines in the direction in which the flexible sheet is inserted into the nipping section. This makes it easy to insert the columnarly projecting section into the cross-section shaped insertion hole of the flexible sheet. That is, it is possible to easily insert the columnarly projecting section into the cross-section shaped insertion hole by inserting, along the inclining surface of the columnarly projecting section, the edge part of the flexible sheet which edge part is present in the direction in which the flexible sheet is inserted into the nipping section. In this manner, the stirring blade can be fixed to the rotation shaft.

The toner stirring member of the present invention can be further configured such that the flexible sheet is made up of polyethylene terephthalate having a thickness not less than 0.1 mm but not more than 0.3 mm.

According to the configuration, the flexible sheet is made up of polyethylene terephthalate having the thickness not less than 0.1 mm but not more than 0.3 mm. Such a flexible sheet is excellent in balance between rigidity and flexibility, and can properly stir toner. Further, the stirring blade can be detached from the rotation shaft by being bent with relatively small force, in a case where the stirring blade is exchanged or recycled. This improves workability.

It can also be said that the first inclining surface of the toner stirring member of the present invention is a surface including (i) a line segment of an edge surface of the projecting section which line segment is perpendicular to the direction in which the flexible sheet is pulled out from the nipping section and (ii) a line segment of a cross section of a projecting direction of the projecting section other than the edge surface of the projecting section, which line segment is parallel to the line segment of the edge surface and is present more upstream in the direction in which the flexible sheet is pulled out from the nipping section than the line segment of the edge surface.

A toner cartridge of the present invention, including the above-described toner stirring member, and a toner container in which the stirring blade is provided rotatably about the rotation shaft.

According to the configuration, the stirring blade can be easily detached with relatively small force. This shortens a time period of recycling the toner cartridge.

The toner cartridge of the present invention can be configured such that the toner container has a first opening from which the flexible sheet of which the stirring blade is made up is pulled out.

According to the configuration, the stirring blade can be easily taken out from the first opening of the toner container with relatively small force.

The present invention encompasses a developing device including the toner cartridge of the present invention, and an image forming apparatus including the developing device.

The present invention is not limited to the description of the embodiments above, and can therefore be modified by a skilled person in the art within the scope of the claims. Namely, an embodiment derived from a proper combination of technical means disclosed in different embodiments is encompassed in the technical scope of the present invention.

Industrial Applicability

The present invention is applicable to a toner stirring member for stirring toner contained in a toner cartridge that is used in an electrophotographic image forming apparatus such as a printer, a copying machine, a facsimile or a multifunction peripheral (MFP: Multi Function Printer).

Reference Signs List

100: image forming apparatus
102: developing device
200: toner cartridge
201: toner container
206: toner stirring member
207*a*: columnar projection (columnarly projecting section)
207*b*: inclining projection (projecting section)
208*a*: stirring blade
208*b*: rotation shaft
218: nipping section
218*a*: first nipping section
218*b*: second nipping section
302: second inclining surface (second inclining surface, inclining surface)
303: first inclining surface (first inclining surface)
304*a*: first insertion hole (cross-section shaped insertion hole)
304*b*: second insertion hole (insertion hole)

The invention claimed is:

1. A toner stirring member, comprising:

a stirring blade made of a flexible sheet and having an insertion hole; and a rotation shaft having (i) a nipping section for nipping the flexible sheet such that the flexible sheet can be inserted into and pulled out from the nipping section and (ii) a projecting section to be inserted into the insertion hole, the toner stirring member being configured such that the stirring blade is fixed to the rotation shaft when the toner stirring member is in such a state that (a) the flexile sheet is nipped by the nipping section and (b) the projecting section is inserted into the insertion hole, the projecting section having a first inclining surface that inclines in a direction in which the flexible sheet is pulled out from the nipping section, the direction in which the flexible sheet is pulled out from the nipping section being parallel to a longitudinal axis of the rotation shaft.

2. The toner stirring member as set forth in claim 1, wherein the projecting section has a second inclining surface that inclines in a direction in which the flexible sheet is inserted into the nipping section.

3. The toner stirring member as set forth in claim 2, wherein the direction in which the flexible sheet is inserted into the nipping section is perpendicular to the longitudinal axis of the rotation shaft.

4. A toner cartridge, comprising:

a toner stirring member as set forth in claim 1; and a toner container in which the stirring blade is provided rotatably about the rotation shaft.

5. The toner stirring member as set forth in claim 1, wherein the projecting section comprises a first projecting section, and wherein the rotation shaft further comprises a second projecting section that does not have an inclining surface that inclines in the direction in which the flexible sheet is pulled out from the nipping section.

6. The toner stirring member as set forth in claim 5, wherein the first projecting section and the second projecting section each have an inclining surface that inclines in a direction in which the flexible sheet is inserted into the nipping section.

7. The toner stirring member as set forth in claim 6, wherein the direction in which the flexible sheet is inserted into the nipping section is perpendicular to the longitudinal axis of the rotation shaft.

8. The toner stirring member as set forth in claim 5, wherein the second projecting section is located adjacent a first side edge of the flexible sheet.

9. The toner stirring member as set forth in claim 8, wherein the rotation shaft further comprises a third projecting section that is located adjacent a second side edge of the flexible sheet that is opposite the first side edge, the third projecting section including an inclining surface that inclines in a direction opposite to the inclining surface of the first projecting section.

* * * * *